US006617532B1

(12) United States Patent
Turek

(10) Patent No.: US 6,617,532 B1
(45) Date of Patent: Sep. 9, 2003

(54) CIRCUIT BREAKER LOCKOUT DEVICE

(75) Inventor: Mark E. Turek, Wheaton, IL (US)

(73) Assignee: Prinzing Enterprises, Inc., Warrenville, IL (US)

( * ) Notice: Subject to any disclaimer, the term of this patent is extended or adjusted under 35 U.S.C. 154(b) by 0 days.

(21) Appl. No.: 10/080,898

(22) Filed: Feb. 21, 2002

(51) Int. Cl.[7] ..... H01H 9/28
(52) U.S. Cl. ..... 200/43.14
(58) Field of Search ..... 200/43.14, 43.15, 200/43.19, 43.21

(56) References Cited

U.S. PATENT DOCUMENTS

| | | | | |
|---|---|---|---|---|
| 2,663,768 A | | 12/1953 | Sorensen | |
| 2,795,663 A | * | 6/1957 | Estes | 200/43.21 |
| 2,849,552 A | | 8/1958 | Firestone | 200/43.15 |
| 3,470,336 A | | 9/1969 | De Angelo | |
| 4,347,412 A | | 8/1982 | Mihara et al. | |
| 4,978,816 A | | 12/1990 | Castonguay et al. | 200/43.14 |
| 5,079,390 A | | 1/1992 | Costanzo et al. | 200/43.14 |
| 5,147,991 A | | 9/1992 | Jordan, Sr. | 200/43.14 |
| 5,300,740 A | | 4/1994 | Benda | 200/43.14 |
| D365,547 S | | 12/1995 | Steinwachs et al. | D13/178 |
| 5,500,495 A | | 3/1996 | Benda et al. | 200/43.14 |
| 5,521,344 A | | 5/1996 | De Leo | 200/43.14 |
| 5,732,815 A | | 3/1998 | Brouwer | 200/43.14 |
| 6,469,264 B2 | * | 10/2002 | Benda | 200/43.14 |

* cited by examiner

*Primary Examiner*—Renee Luebke
(74) *Attorney, Agent, or Firm*—McAndrews, Held & Malloy, Ltd.

(57) ABSTRACT

A switch lockout device for securing a toggle switch of a circuit breaker. The lockout device includes a housing having an opening for positioning around the toggle switch. A screw is threaded through the housing and is tightened against the toggle switch to restrain it. A circular disk is secured at one end of the screw and is lockable to a member slidable with respect to the housing, for preventing the disk from movement.

31 Claims, 3 Drawing Sheets

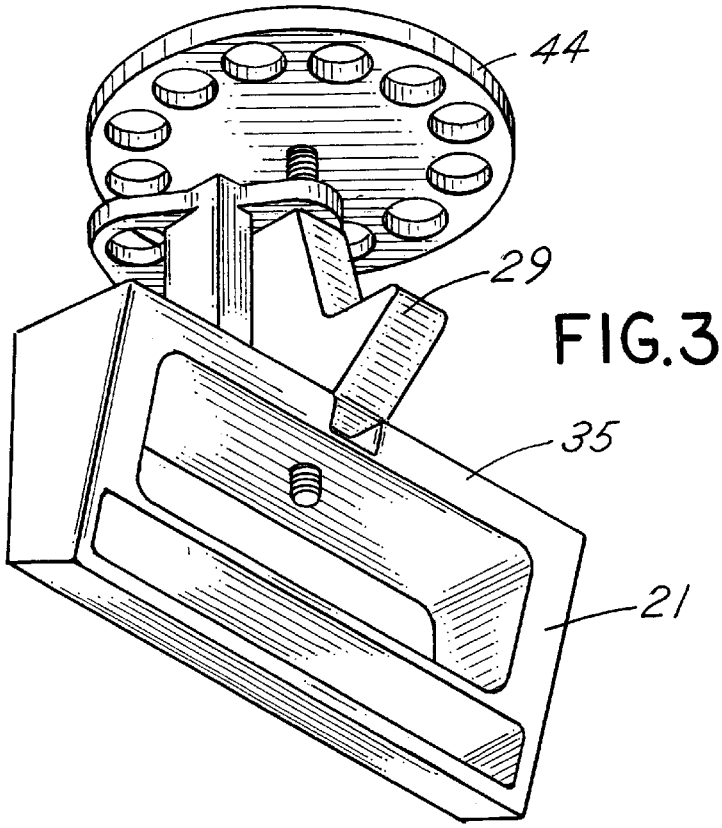
FIG.3
FIG.4
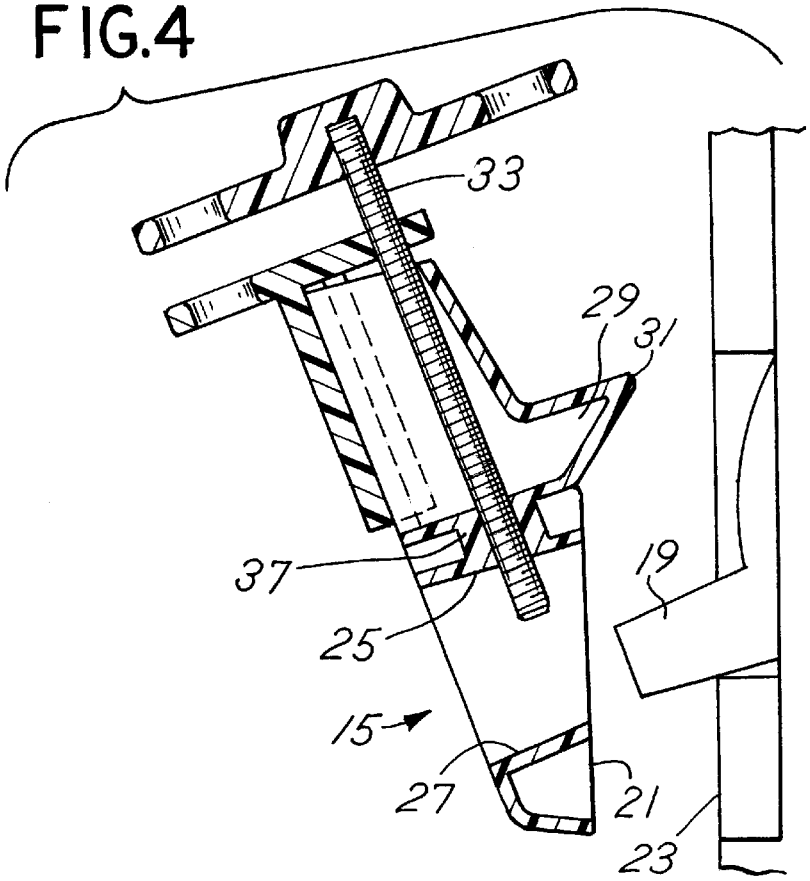

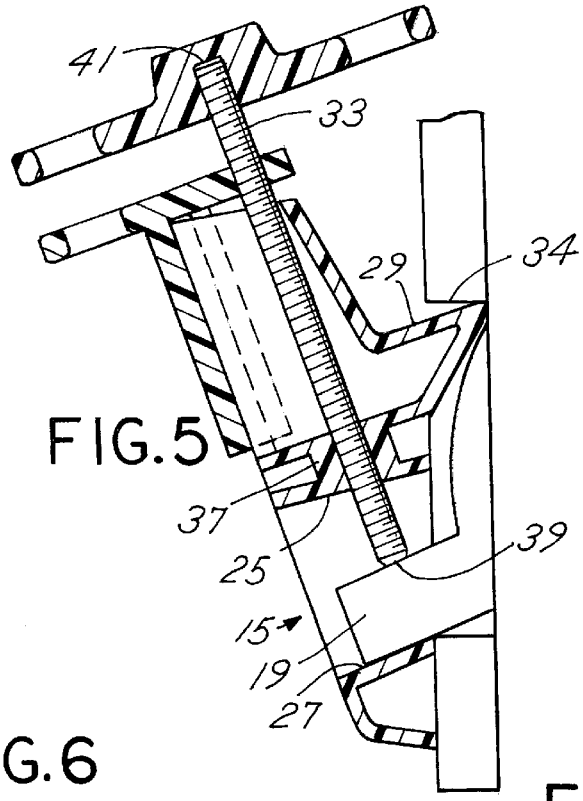
FIG.5
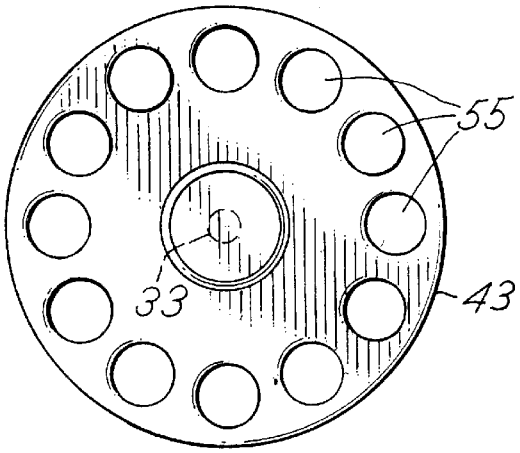
FIG.6
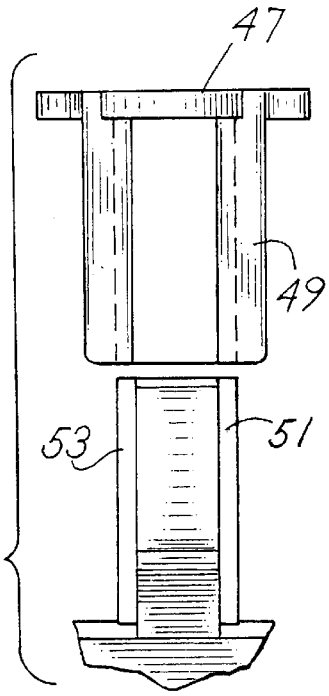
FIG.8
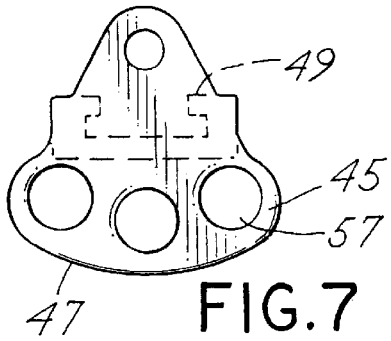
FIG.7
FIG.9
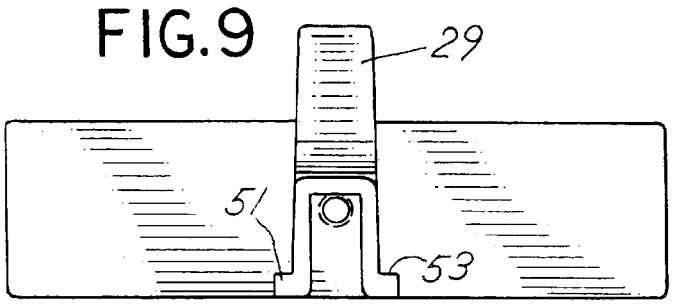

CIRCUIT BREAKER LOCKOUT DEVICE

CROSS-REFERENCE TO RELATED APPLICATION

Not applicable

STATEMENT REGARDING FEDERALLY SPONSORED RESEARCH OR DEVELOPMENT

Not applicable.

BACKGROUND OF THE INVENTION

The present invention relates to a toggle switch lockout device, and more particularly relates to a device for locking a toggle switch such as a circuit breaker switch in either the ON or OFF position.

Lock out devices are used to secure the setting or position of a toggle switch in either its ON position or its OFF position. Such lockout devices may be used to ensure safety during work on electrical circuits by locking a toggle circuit breaker in its OFF position. This prevents someone from accidentally or inadvertently turning the power ON to the circuit while maintenance or other work is being performed on the circuit. Alternatively, the toggle switch may be locked to its ON position so as to prevent someone from turning the power OFF.

Toggle switch lockout devices are known in the art, and generally include a housing which is positioned over the toggle switch and secured into position. Once in place, the housing prevents the normal movement of the toggle switch by obstructing the toggle switch's path of movement, which is typically arcuate. The shackle portion of a padlock is passed through apertures in the housing to prevent the removal of the housing from the toggle switch.

For example, U.S. Pat. No. 2,839,552 discloses a circuit breaker locking device in which a set screw is tightened against the handle of the toggle switch to fix the housing onto the handle and keep the handle in its ON position. The handle cannot be pivoted to its OFF position because the housing confronts the circuit breaker casing. The shackle portion of a padlock is next inserted through an aperture in the housing in order to block access to the set screw preventing the screw from being loosened to remove the housing. This device requires a tool, for example, a screw driver, to work the set screw so as to secure the device.

U.S. Pat. No. 5,732,815 discloses a similar circuit breaker lockout device in which a set screw carries an integral, but pivotable, thumb screw which is manually rotated in order to the drive the set screw. Rotation of the thumb screw is prevented by pivotable movement of the thumb screw out of alignment with the set screw. A shackle of a padlock is inserted into the device to prevent the thumb screw from pivoting back into realignment with the set screw, and thus prevent use of the thumb screw to release the set screw. This device requires a special set screw having a knuckle joint for pivotable connection of the set screw to the thumb screw. Such a set screw adds cost and complexity to the manufacture of the device.

It is therefore an object of the present invention to provide an improved toggle switch lockout device.

It is yet another object of the present invention to provide a toggle switch device which does not require any additional tools for use.

It is also an object of the present invention to provide a toggle switch lockout device, which is of simple, of rugged construction and inexpensive to manufacture.

It is also an object of the present invention to provide a toggle switch lockout device that allows for a plurality of padlocks to be used to secure the switch.

SUMMARY OF THE INVENTION

These and other objects of the invention are achieved in a lockout device comprising a housing member having an opening for receiving the handle of the toggle switch. A securement member is manually operable for securing the housing member onto the handle. The securement member includes a drive member for operating the securement member. The housing and the drive member include openings for receiving the shackle portion of a conventional padlock so that the securing member is prevented from releasing the housing from the handle of toggle switch.

BRIEF DESCRIPTION OF THE DRAWINGS

FIG. 3 is a perspective view of the lockout device of FIG. 2.

FIG. 4 is a cut away side view of the lockout device of FIG. 1 and a partial cutaway view of the switch handle area of a conventional circuit breaker.

FIG. 5 is a side view of the lockout device of FIG. 1, shown secured to the switch handle of the conventional circuit breaker of FIG. 4.

FIG. 6 is an end view of a drive disk of the lockout device of FIG. 1.

FIG. 7 is an end view of a disk section member of the lockout device of FIG. 1.

FIG. 8 is a top view of the disk section member of FIG. 7 detached from the rear portion of the housing of the switch lockout device of FIG. 1.

FIG. 9 is an end view of the housing of the switch lockout device of FIG. 1, without the disk section member of FIG. 7.

DETAILED DESCRIPTION OF THE PREFERRED EMBODIMENT

Figure 1:
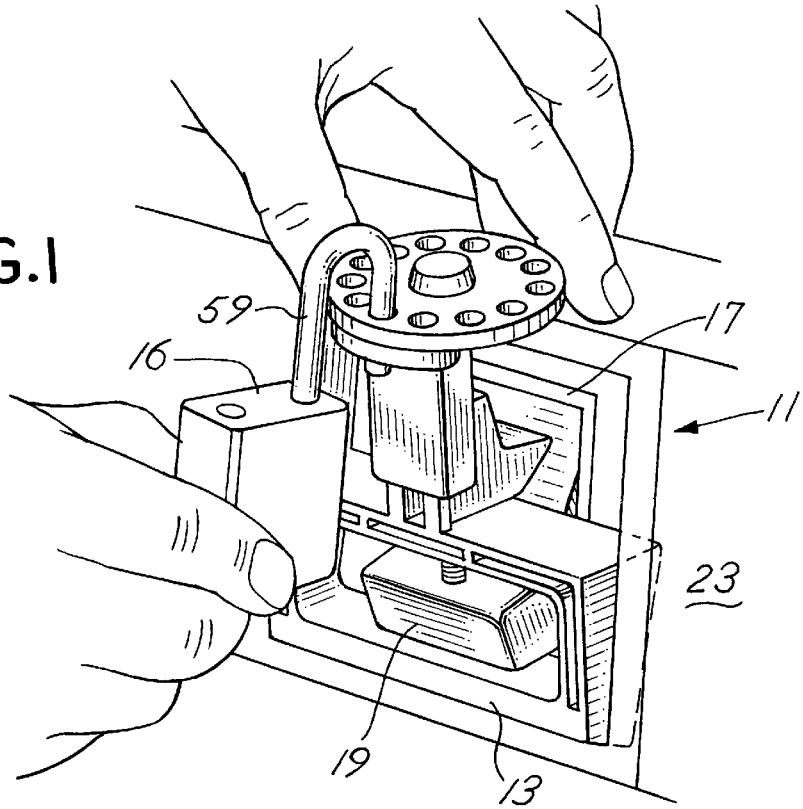
FIG. 1 is a perspective view of an embodiment of a lockout device of the present invention being used to lockout a conventional circuit breaker.
Figure 2:
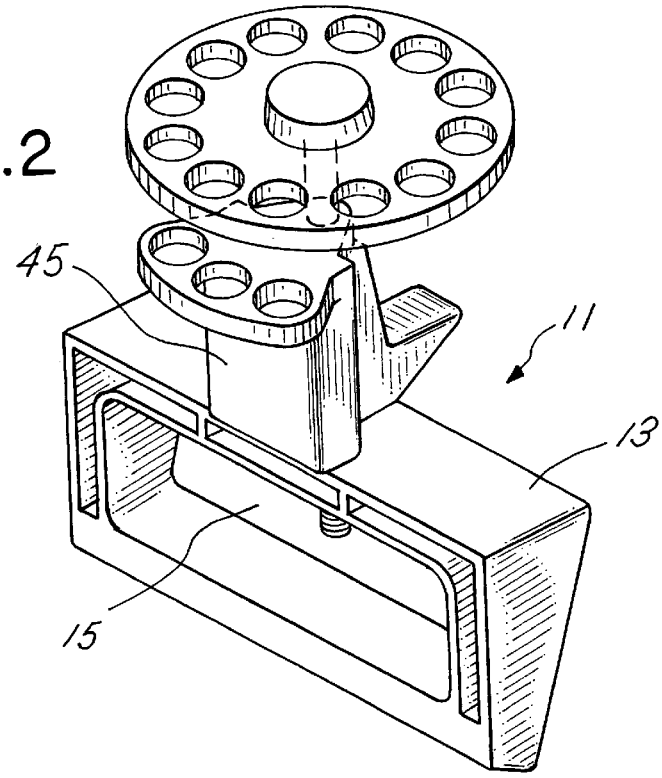
FIG. 2 is a perspective view of the lockout device of FIG. 1.

Referring to FIGS. 1, 2 and 3, a lockout device 11 includes a housing 13 having a central opening 15. As shown in FIG. 1, the housing is placed over a conventional circuit breaker 17, allowing the handle 19 of the circuit breaker to pass through opening 15. The bottom side of housing 13 includes a planar bottom surface 21 (FIG. 3) for positioning against the top surface 23 (FIG. 1) of the circuit breaker.

As shown in FIG. 4, opening 15 passes completely through the housing 13 and is shaped by forward and rearward planar side wall surfaces 25, 27, respectively, which are angled relative to bottom surface 21. The angle of surfaces 25, 27 may correspond to the angle at which switch handle 19 projects from top surface 23.

As shown in FIGS. 3 and 4, housing 13 includes a brake projection 29 which extends outwardly from the plane of bottom surface 21. Brake projection 29 is triangular in cross sectional shape, providing a linear brake edge 31 (FIG. 3).

As shown in FIG. 5, brake projection 29 seats against the curved portion of the breaker switch when the housing 13 is placed over the circuit breaker and secured onto handle 19. As the handle is forced toward its other position, brake projection 29 provides a stop for contact with the circuit breaker wall 34.

As shown in FIGS. 3, 4 and 5, lockout device 11 includes a cylindrical set screw 33 which extends through the rear wall 35 (FIG. 3) of the housing and into opening 15. Screw 33 is disposed substantially perpendicular to the sidewall surface 25 formed on rear wall 35. A threaded area 37 is formed in rear wall 35 allowing the screw 33 to move into and out of opening 15 as the screw is rotated.

Distal end 39 of the screw is driven against one side of handle 19 of the breaker, as shown in FIG. 5. The other side of handle 19 is forced against wall surface 27 . Thus, handle 19 is clamped between wall surface 27 and screw end 39, securing housing 13 to the circuit breaker.

The opposite end 41 of screw 33 is secured tightly within a circular drive disk 43. As shown in FIG. 6, drive disk 43 includes a plurality of circular openings 55 arranged around the circumference of disk 43. Disk 43 is easily rotated in order to move screw 33 toward and away from handle 19. The user may place the end portion his or her finger within one of openings 55 to "dial" the disk 43 for quickly rotating screw 33. The user may also use the outer circumferential edge 44 (FIG. 3) of disk 43 to rotate the disk, thus allowing for more hand leverage (more torque) to be transmitted to the screw to tighten the screw against the handle. This assures for a tighter clamp.

Referring again to FIG. 2, lockout device 11 includes a lock member 45 which is slidably connected to housing 13. As shown in FIG. 7, lock member 45 includes a disk section member 47 having a radius equal to that of disk 43 and a central aperture for receiving screw 33. Disk section member 47 includes a plurality, for example three, circular openings 57 of equal size as openings 55 of disk 43. Openings 57 are arranged around the circumference of member 47 so as to align with three consecutive openings 55.

Lock member 45 also includes a U-shaped longitudinal slide 49, as shown in FIGS. 7 and 8, for slidingly receiving a pair of flanges 51, 53 of the housing 13, as also shown in FIG. 8. Flanges 51, 53 extend laterally of the housing, as shown in FIG. 9.

In use, lockout device 11 is placed over the handle 19 of circuit breaker 17, with the switch breaker in the ON or OFF position. The circular disk 43 is rotated to drive set screw 33, and its end 39, into engagement with handle 19 to secure the switch breaker in the desired position. Disk 43 moves laterally relative to housing 13, being carried by screw 33 along the longitudinal axis of the screw, and occupies a "lock" position when screw 33 can no longer be driven further into the opening 15 due to its forced contact against handle 19. Lock member 45 is next slid outwardly to mate against circular disk 43, when the disk occupies its lock position, aligning openings 55 with openings 57. Disk 43 may be rotated slightly so as to align the three openings 57 with three openings 55, if necessary.

As shown in FIG. 1, a shackle 59 of a padlock 61 is inserted through one set of aligned openings 55, 57. This prevents disk 43 from rotation relative to housing 13, and thus prevents screw 33 from being released from handle 19, and thus prevents removal of the lockout device 11 from the circuit breaker 17.

As will suggest itself, the device allows up to three padlocks to be installed, the shackle of one lock passing through one aligned aperture 57. This protects up to three different workers or union tradesmen who may be working on equipment energized by the breaker. Each worker is protected until all workers have removed their own locks. As will suggest itself, disk section member 47 may be enlarged sectorially in its manufactured shape, while maintaining a radial extent no greater than that of disk 43, so as to provide for additional openings 57, if so desired.

The housing 13, lock-member 45 and circular drive disk 43 are formed of plastic. Screw 33 is formed of metal. As will suggest itself, these three components 13, 43, 45 may take on different shapes than that set out in the drawings.

It is to be noted that while an embodiment of the present invention has been shown and described as being used on a circuit breaker toggle switch, other embodiments of the invention may be used on any toggle type switch. In addition, the particular area of contact of brake projection 29 against circuit breaker 17, as shown in FIG. 5, of course, is determined by the shape of the circuit breaker and its switch handle.

While the invention has been particularly shown and described with reference to a preferred embodiment thereof, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. A switch lockout device, for use with a conventional padlock or other lock having a shackle, for preventing a toggle switch from being rotated, comprising:

a housing having an opening for positioning around the toggle switch;

securing means being drivable for removably securing said housing to the toggle switch;

a drive member connected to said securing means; and a lock member being slidable to engage said drive member, said lock member for receiving a shackle of a lock for preventing said drive member from driving said securing means.

2. A switch lockout device according to claim 1 wherein said drive member also receives the shackle of the lock.

3. A switch lockout device according to claim 1 wherein said lock member is slidably engaged with said housing for movement relative to said drive member.

4. A switch lockout device according to claim 3 wherein said drive member occupies a lock position relative to said housing as said securing means is driven to a point of securing said housing, and wherein said lock member is slidable to engage said drive member at its said lock position.

5. A switch lockout device according to claim 1 wherein said securing means is a set screw drivable into and out of said opening.

6. A switch lockout device according to claim 5 wherein said housing includes threads for mating with said set screw.

7. A switch lockout device according to claim 5 wherein said housing includes a wall having a threaded aperture which engages said set screw.

8. A switch lockout device according to claim 5 wherein said set screw is a metal threaded shaft and includes a distal end for making contact with said toggle switch.

9. A switch lockout device according to claim 1 and further including a stop, said stop being a triangular shaped member formed integral with and projecting from one side of said housing.

10. A switch lockout device according to claim 1 wherein said housing and said lock member are made of plastic.

11. A switch lockout device according to claim 1 wherein said lock member has a plurality of apertures for receiving a plurality of separate locks.

12. A switch lockout device according to claim 1 wherein said securing means includes a distal end that engages one side of the toggle switch to secure said housing to the toggle switch.

13. A switch lockout device according to claim 1 wherein said drive member includes a circular drive disk with a plurality of openings arranged around the circumference thereof and said lock member includes a disk section having a plurality of openings arranged around the circumference thereof, said openings of said drive member being radially aligned with said openings of said lock member.

14. A switch lockout device according to claim 1 wherein said lock member and said drive member each include a plurality of openings and said lock member and said drive member are positionable relative to each other such that said openings of said drive member are aligned with said openings of said lock member.

15. A switch lockout device according to claim 1 and further including a slide and flanges; said flanges slidingly receiving said slide whereby said lock member slides relative to said housing to engage said drive member.

16. A switch lockout device according to claim 1 wherein said lock member includes a U-shaped longitudinal slide engaging said housing such that said lock member is slidably positionable relative to said housing.

17. A switch lockout device according to claim 1 wherein said lock member includes flanges extending laterally therefrom, said flanges slidably engaging said housing such that said lock member is slidably positionable relative to said housing.

18. A switch lockout device, for use with a conventional padlock or other lock having a shackle, for preventing a toggle switch from being toggled from a first position to a second position, comprising:

a housing having a contact surface, said housing being positionable relative to said toggle switch;

a screw drivable relative to said housing and arranged for tightening said toggle switch against said contact surface to secure said housing to said toggle switch;

a drive member secured to said screw and shaped for user manipulation, manipulation of said drive member causing rotating of said screw, said drive member occupying a lock position when said housing is secured to said toggle;

a lock member positionable relative to said housing, said lock member being slidably engaged with said housing for movement relative to said drive member and engageable with said drive member when said drive member is in its said lock position, said lock member receiving a shackle of a lock for preventing said drive member from causing rotation of said screw.

19. A switch lockout device according to claim 18 wherein said drive member also receives the shackle of the lock.

20. A switch lockout device according to claim 18 wherein said housing includes a wall having a threaded aperture which engages said screw.

21. A switch lockout device according to claim 18 wherein said housing and said lock member are made of plastic.

22. A switch lockout device according to claim 18 and further including a stop.

23. A switch lockout device according to claim 18 wherein said stop is a triangular shaped member formed integral with and projecting from one side of said housing.

24. A switch lockout device according to claim 18 wherein said lock member is constructed to receive a plurality of shackles from a plurality of locks.

25. A switch lockout device according to claim 24 wherein said lock member has a plurality of apertures for receiving a plurality of separate locks.

26. A switch lockout device according to claim 18 wherein said screw includes a distal end that engages one side of the toggle switch to secure said housing to the toggle switch.

27. A switch lockout device according to claim 18 wherein said drive member includes a circular drive disk with a plurality of openings arranged around the circumference thereof and said lock member includes a disk section having a plurality of openings arranged around the circumference thereof, said openings of said drive member being radially aligned with said openings of said lock member.

28. A switch lockout device according to claim 18 wherein said lock member and said drive member each include a plurality of openings and said lock member and said drive member are positionable relative to each other such that said openings of said drive member are aligned with said openings of said lock member.

29. A switch lockout device according to claim 18 and further including a slide and flanges; said flanges slidingly receiving said slide whereby said lock member slides relative to said housing to engage said drive member.

30. A switch lockout device according to claim 18 wherein said lock member includes a U-shaped longitudinal slide engaging said housing such that said lock member is slidably positionable relative to said housing.

31. A switch lockout device according to claim 18 wherein said lock member includes flanges extending laterally therefrom, said flanges slidably engaging said housing such that said lock member is slidably positionable relative to said housing.

* * * * *